US008788084B2

(12) United States Patent
Niemann et al.

(10) Patent No.: US 8,788,084 B2
(45) Date of Patent: Jul. 22, 2014

(54) CONTROL METHOD FOR THE MENISCUS OF A CONTINUOUS CASTING MOLD

(75) Inventors: Martin Niemann, Erlangen (DE); Bernhard Weisshaar, Herzogenaurach (DE)

(73) Assignee: Siemens Aktiengesellschaft, Munich (DE)

( * ) Notice: Subject to any disclaimer, the term of this patent is extended or adjusted under 35 U.S.C. 154(b) by 392 days.

(21) Appl. No.: 13/380,686

(22) PCT Filed: May 6, 2010

(86) PCT No.: PCT/EP2010/056151
§ 371 (c)(1),
(2), (4) Date: Dec. 23, 2011

(87) PCT Pub. No.: WO2010/149419
PCT Pub. Date: Dec. 29, 2010

(65) Prior Publication Data

US 2012/0101625 A1 Apr. 26, 2012

(30) Foreign Application Priority Data

Jun. 24, 2009 (EP) ..... 09163538

(51) Int. Cl.
*B22D 11/00* (2006.01)
*B22D 11/14* (2006.01)
*B22D 11/16* (2006.01)

(52) U.S. Cl.
USPC ..... 700/197; 700/204; 164/154.1; 164/154.4; 164/154.5; 164/154.6; 164/154.7; 164/413; 164/447; 164/449.1; 164/451; 164/452; 164/459

(58) Field of Classification Search
CPC ..... B22D 11/00; B22D 11/14; B22D 11/16
USPC ..... 700/197, 204; 164/154.1, 154.4, 154.5, 164/154.6, 154.7, 413, 449.1, 447, 451, 164/452, 459
See application file for complete search history.

(56) References Cited

U.S. PATENT DOCUMENTS 5,605,188 A * 2/1997 Banny et al. ..... 164/453
5,699,850 A * 12/1997 Beitelman et al. ..... 164/468

(Continued)

FOREIGN PATENT DOCUMENTS

DE 19640806 A1 4/1998 ..... B22D 11/20
RU 2114715 C1 7/1998 ..... B22D 11/16

(Continued)

OTHER PUBLICATIONS

International PCT Search Report and Written Opinion, PCT/EP2010/056151, 13 pages, Mailed Jun. 17, 2010

(Continued)

*Primary Examiner* — Ronald Hartman, Jr.
(74) *Attorney, Agent, or Firm* — King & Spalding L.L.P.

(57) ABSTRACT

The inflow of liquid metal into a continuous casting mold is set by a closure device. A measured actual meniscus value is fed to a controller determining a closure device target position on the basis of the actual and a corresponding target value. The measured actual value is fed to a disturbance variable compensator. The target position/corrected target position or a corresponding actual value are further fed to the disturbance variable compensator which determines the disturbance variable compensation value. The disturbance variable compensator has a model of the continuous casting mold for determining an expected value. A number of oscillating compensators determine a frequency disturbance proportion. The sum of the frequency disturbance proportions corresponds to the disturbance variable compensation value. The disturbance variable compensator has a jump determiner, by which it determines the jump compensation value by integrating the difference.

21 Claims, 4 Drawing Sheets

(56) References Cited

U.S. PATENT DOCUMENTS

| | | | | |
|---|---|---|---|---|
| 5,921,313 | A | 7/1999 | Niemann et al. | 164/453 |
| 6,453,985 | B2 * | 9/2002 | Nakata et al. | 164/466 |
| 6,712,122 | B2 * | 3/2004 | Suzuki et al. | 164/453 |
| 7,975,753 | B2 * | 7/2011 | Lehman et al. | 164/466 |
| 8,167,024 | B2 * | 5/2012 | Kunstreich | 164/468 |
| 2001/0004932 | A1 * | 6/2001 | Nakata et al. | 164/466 |
| 2002/0079083 | A1 * | 6/2002 | Suzuki et al. | 164/453 |
| 2009/0084517 | A1 * | 4/2009 | Thomas et al. | 164/454 |
| 2009/0120604 | A1 * | 5/2009 | Lehman et al. | 164/466 |
| 2009/0138223 | A1 * | 5/2009 | Kim et al. | 702/81 |
| 2012/0101625 | A1 | 4/2012 | Niemann et al. | 700/200 |

FOREIGN PATENT DOCUMENTS

| | | | | |
|---|---|---|---|---|
| RU | 2120837 | C1 | 10/1998 | B22D 11/16 |
| WO | 2010/149419 | A1 | 12/2010 | B22D 11/16 |

OTHER PUBLICATIONS

Krasnow, B.I, "Optimierte Steuerung für Stahlstranggiessenprozesse," Verlag Metallurgia, 5 pages (w/ English translation), 1970.

* cited by examiner

CONTROL METHOD FOR THE MENISCUS OF A CONTINUOUS CASTING MOLD

CROSS-REFERENCE TO RELATED APPLICATIONS

This application is a U.S. National Stage Application of International Application No. PCT/EP2010/056151 filed May 6, 2010, which designates the United States of America, and claims priority to EP Patent Application No. 09163538.3 filed Jun. 24, 2009. The contents of which are hereby incorporated by reference in their entirety.

TECHNICAL FIELD

The present invention relates to a control method for the meniscus of a continuous casting mold,

- wherein the inflow of liquid metal into the continuous casting mold is set by means of a closure device and the partially solidified metal strand is withdrawn from the continuous casting mold by means of a withdrawal device,
- wherein a measured actual value of the meniscus is fed to a meniscus controller, which uses the actual value and a corresponding target value to determine a target position for the closure device,
- wherein the measured actual value of the meniscus is fed to a disturbance variable compensator,
- wherein the target position for the closure device, a target position for the closure device corrected by a disturbance variable compensation value, an actual position of the closure device or an actual position of the closure device corrected by the disturbance variable compensation value are further fed to the disturbance variable compensator,
- wherein the disturbance variable compensator calculates the variable compensation value on the basis of the values fed to it,
- wherein the target position corrected by the disturbance variable compensation value is fed to the closure device,
- wherein the disturbance variable compensator comprises a model of the continuous casting mold, by means of which the disturbance variable compensator determines an expected value for the meniscus on the basis of a model input value,
- wherein the disturbance variable compensator comprises a number of oscillating compensators, by means of which the disturbance variable compensator determines the interference frequency component on the basis of the difference between the actual value and expected value in each case relative to a respective interference frequency,
- wherein the sum of the interference frequency components corresponds to the disturbance variable compensation value.

BACKGROUND

A control method of this kind is known, for example, from U.S. Pat. No. 5,921,313 A. The known control method only has one single oscillating compensator. In this case, the sum of the interference frequency components is identical to the sole interference frequency component determined.

The various embodiments disclosed herein also relates to a computer program, which comprises a machine code, which can be implemented directly by a control device for a continuous casting machine and the execution of which by the control device causes the control device to control the meniscus of a continuous casting mold of the continuous casting machine according to a control method of this kind.

The various embodiments disclosed herein also relates to a control device for a continuous casting machine, which is embodied in such a way that, in operation, it executes a control method of this kind.

Finally, the various embodiments disclosed herein relates to a continuous casting machine, which is controlled by a control device of this kind.

During continuous casting, the cast strand is withdrawn from the continuous casting mold while the core of the strand is still liquid. When the strand has emerged from the continuous casting mold, the strand is guided and supported over roll pairs to support the strand shell against the metallostatic pressure of the core. The support prevents inter alia bulging of the cast strand on the broad side of the strand. The spacing of the rolls, which support the strand at the same point on both sides, must correspond to the desired strand thickness.

After emerging from the continuous casting mold, the cast strand is actively and/or passively cooled. The cooling causes the strand thickness to shrink. For this reason, the rolls supporting the cast strand at the same point on both sides must have the correct spacing from each other. Until complete solidification, also known as the crater end, the cast strand has not completely solidified. Therefore, it has a liquid core. Therefore, uneven impacts on the strand as it passes through the roll pairs exert an effect on the meniscus. However, for various reasons, for example due to the risk of casting powder being drawn into the surface of the strand, meniscus level fluctuations should be avoided where possible.

Fluctuations in the shell thickness that develop in the continuous casting mold can result in the occurrence of so-called "unsteady bulging" when passing through the roll pairs. The "bulging" is caused when a point with impaired shell thickness passes through different roll pairs one after the other and the meniscus therefore undergoes cyclical changes. Since, when viewed in the direction of transport of the strand, the roll pairs generally have constant spacing from one another and the withdrawal speed at which the strand is withdrawn from the continuous casting mold is constant, "unsteady bulging" results in periodic changes in the meniscus level. Consequently, oscillations with a constant frequency form in the meniscus.

The control method known from U.S. Pat. No. 5,921,313 A has the object of overcoming meniscus fluctuations of this kind. The known control method already works very well. In particular, it enables the meniscus to be regulated precisely to a few millimeters.

From the specialist article "Suppression of Periodic Disturbances in Continuous Casting using an Internal Model Predictor" by C. Furtmueller and E. Gruenbacher, IEEE International Conference on Control Applications, Munich, Germany, Oct. 4-6, 2006, pp. 1764 to 1769, a control method is known for the meniscus of a continuous casting mold in which the inflow of liquid metal into the continuous casting mold is set by means of a closure device and the partially solidified metal strand is withdrawn from the continuous casting mold by means of a withdrawal device. A measured actual value of the meniscus is fed to a meniscus controller, which determines a target position for the closure device on the basis of the actual value and a corresponding target value. The motor currents from drives of the withdrawal device are subjected to a frequency analysis. The components of a fundamental frequency and its harmonic frequencies are used to determine a disturbance variable compensation value, which is connected to the output signal of the meniscus controller.

The closure device is controlled according to the output signal of the meniscus controller corrected in this manner.

SUMMARY

According to various embodiments, opportunities for achieving even more precise control can be provided.

According to an embodiment, in a control method for the meniscus of a continuous casting mold,—the inflow of liquid metal into the continuous casting mold is set by means of a closure device and the partially solidified metal strand is withdrawn from the continuous casting mold by means of a withdrawal device,—a measured actual value of the meniscus is fed to a meniscus controller, which determines a target position for the closure device on the basis of the actual value and a corresponding target value,—the measured actual value of the meniscus is fed to a disturbance variable compensator,—the target position for the closure device, a target position for the closure device corrected by a disturbance variable compensation value, an actual position of the closure device or an actual position of the closure device corrected by the disturbance variable compensation value are further fed to the disturbance variable compensator,—the disturbance variable compensator determines the disturbance variable compensation value on the basis of values fed to it,—the target position corrected by the disturbance variable compensation value is fed to the closure device,—wherein the disturbance variable compensator comprises a model of the continuous casting mold, by means of which the disturbance variable compensator determines an expected value for the meniscus on the basis of a model input value,—wherein the disturbance variable compensator comprises a number of oscillating compensators, by means of which the disturbance variable compensator determines an interference frequency component on the basis of a difference between the actual value and the expected value each relative to a related interference frequency,—wherein the sum of the interference frequency components corresponds to the disturbance variable compensation value,—wherein the model input value is determined by the relationship $i=p'+z'$ wherein $p'$ is the uncorrected target or actual position of the closure device and $z'$ is a jump compensation value,—and wherein the disturbance variable compensator comprises a jump determiner, by means of which the disturbance variable compensator determines the jump compensation value by integrating the difference between actual value and expected value.

According to a further embodiment,—the model of the continuous casting mold consists of a series connection of a model integrator with a model delay element, each oscillating compensator consists of a series connection of two oscillating integrators and the jump determiner consists of an individual jump integrator,—as the respective input value

- a value $m=Vi+h1e$ is fed to the model integrator,
- a value $m'=I+h2e$ is fed to the model delay element,
- a value $s1=h3e-S2$ is fed to the front oscillation generator of a respective oscillation compensator,
- a value $s2=h4e+S1$ is fed to the back oscillation generator of a respective oscillation compensator and
- a value $s3=h5e$ is fed to the jump integrator, wherein
- V is an amplification factor,
- i is the model input value,
- e is the difference between the actual value and the expected value,
- I is the output signal from the model integrator,
- S1 is the output signal from the respective front oscillation generator,
- S2 is the output signal from the respective back oscillation generator,
- h1 and h2 are model adaptation factors,
- h3 and h4 are specific oscillation adaptation factors for the respective oscillating compensator and
- h5 is a jump adaptation factor.

According to a further embodiment, the adaptation factors can be determined in such a way that the poles of the transmission function determined by the model of the continuous casting mold fulfill the following conditions:—for each interference frequency, a pair of conjugate complex poles is formed, whose real parts are smaller than zero and whose imaginary parts are equal to an angular interference frequency defined by the respective interference frequency,—three real poles are formed, which are all smaller than zero. According to a further embodiment, the adaptation factors can be determined in such a way that the real parts of the conjugate-complex poles, relative to the respective angular interference frequency, are between −0.3 and −0.1. According to a further embodiment, the adaptation factors can be determined in such a way that the real poles are all smaller than −2.0. According to a further embodiment, the adaptation factors can be determined in such a way that the real poles differ from one another in pairs. According to a further embodiment, the adaptation factors can be determined in such a way that one of the real poles is between −2.5 and −3.5, one is between −3.5 and −4.5 and one is between −4.5 and −5.5.

According to a further embodiment, the number of oscillating compensators can be greater than one. According to a further embodiment, the target position for the closure device or the target position for the closure device corrected by the disturbance variable compensation value can be fed to the disturbance variable compensator, but not the actual position of the closure device or the actual position of the closure device corrected by the disturbance variable compensation value.

According to another embodiment, a computer program may comprise a machine code that can be executed directly by a control device for a continuous casting machine and the execution of which by the control device causes the control device to control the meniscus of a continuous casting mold of the continuous casting machine according to a control method as described above.

According to a further embodiment of the computer program, the program can be stored on a data medium in machine-readable form. According to a further embodiment of the computer program, the data medium can be a component of the control device.

According to another embodiment, a control device for a continuous casting machine can be embodied in such a way that, in operation, it executes a control method as described above.

According to yet another embodiment, a continuous casting machine can be controlled by a control device as described above.

BRIEF DESCRIPTION OF THE DRAWINGS

Further advantages and details are disclosed in the following description and exemplary embodiments in conjunction with the drawings, which show.

DETAILED DESCRIPTION

Figure 1:
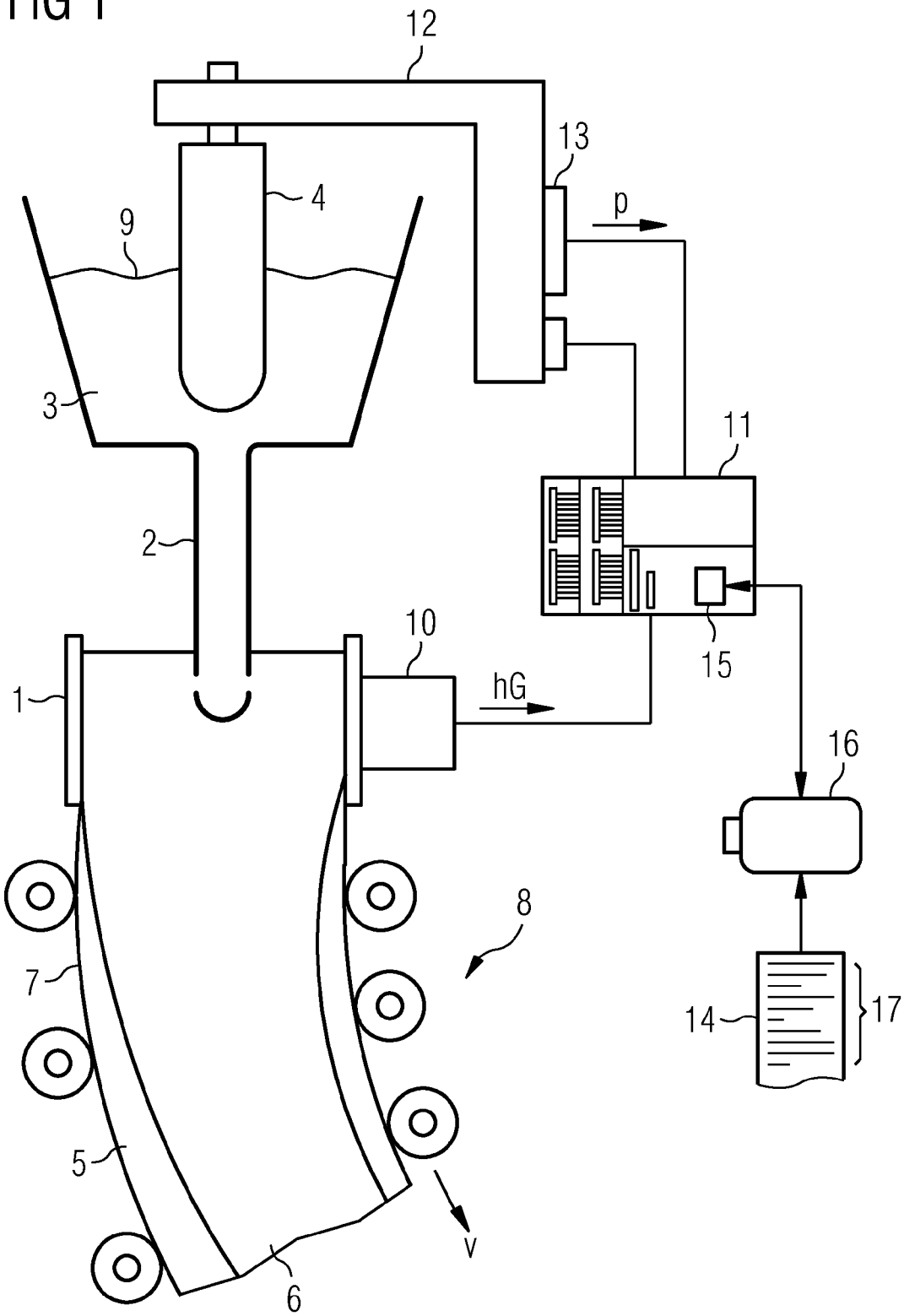
FIG. 1 a schematic diagram of a continuous casting machine

According to various embodiments, a control method of the type mentioned in the introduction can be provided in such a way that the model input value is determined by the relationship $$i=p'+z'$$

wherein p' is the uncorrected target or actual position of the closure device and z' is a jump compensation value, and that the disturbance variable compensator comprises a jump determiner by means of which the disturbance variable compensator determines the jump compensation value by integrating the difference between the actual value and the expected value.

In an embodiment, it is provided that the model of the continuous casting mold consists of a series connection of a model integrator with a model delay element, where each oscillating compensator consists of a series connection of two oscillating integrators and the jump determiner consists of a jump integrator, that as the respective input value a value m=Vi+h1e is fed to the model integrator, a value m'=I+h2e is fed to the model delay element, a value s1=h3e−S2 is fed to the front oscillation generator of a respective oscillation compensator, a value s2=h4e+S1 is fed to the back oscillation generator of a respective oscillation compensator and s3=h5e is fed to the jump integrator, wherein V is an amplification factor, i is the model input value, e is the difference between the actual value and the expected value, I is the output signal from the model integrator, S1 is the output signal from the respective front oscillation generator, S2 is the output signal from the respective back oscillation generator, h1 and h2 are model adaptation factors, h3 and h4 are specific oscillation adaptation factors for the respective oscillating compensator and h5 is a jump adaptation factor.

The different adaptation factors can be determined as required. In experiments, good results can be achieved if the adaptation factors are determined in such a way that the poles of the transmission function determined by the model of the continuous casting mold fulfill the following conditions:

for each interference frequency, a pair of conjugate-complex poles is formed, whose real parts are smaller than zero and whose imaginary parts are equal to an angular interference frequency defined by the respective interference frequency, three real poles are formed, which are all smaller than zero.

In an embodiment, it is also provided that the adaptation factors are determined in such a way that the real parts of the conjugate-complex poles, relative to the respective angular interference frequency, are between −0.3 and −0.1. In particular a value of about −0.2 is desirable. Good damping properties were achieved with values of this kind in experiments.

Preferably, the adaptation factors are determined in such a way that the real poles are all smaller than −2.0. In this case, the control method still works reliably and stably even if the model of the continuous casting mold is only a very imprecise model of the real continuous casting mold.

Particularly good results can also be achieved if the adaptation factors are determined in such a way that the real poles differ from one another in pairs.

Obviously, the last two measures named (real poles smaller than −2.0 and differing from one another in pairs) can be combined with each other. Optimum results are achieved when the real poles are −3.0, −4.0 and −5.0, in each case +/−0.5.

The number of oscillating compensators is preferably greater than one. This makes it possible to compensate for more than one "bulging-oscillation".

It is also preferable for the target position for the closure device or the target position for the closure device corrected by the disturbance variable compensation value to be fed to the disturbance variable compensator, but not the actual position of the closure device or the actual position of the closure device corrected by the disturbance variable compensation value. This produces better results.

According to further embodiments, a computer program of the type mentioned in the introduction can be provided such that when executed causes the control device to control the meniscus of the continuous casting mold according to a control method according to various embodiments. The computer program can, for example, be stored on a data medium in machine-readable form. The data medium can in particular be a component of the control device.

According to further embodiments, a control device for a continuous casting machine can be embodied in such a way that, in operation, it executes a control method according to various embodiments. Finally, according to yet further embodiments a continuous casting machine can be controlled by a control device according to various embodiments.

According to FIG. 1, a continuous casting machine comprises a continuous casting mold 1. Liquid metal 3, for example steel or aluminum, is poured into the continuous casting mold 1 through an immersion tube 2. The inflow of the liquid metal 3 into the continuous casting mold 1 is set by means of a closure device 4. FIG. 1 shows an embodiment of the closure device 4 as a sealing plug. In this case, a position of the closure device 4 corresponds to a lift position of the sealing plug. Alternatively, the closure device 4 can be embodied as a slide. In this case, the closure position corresponds to the slide position.

The liquid metal 3 in the continuous casting mold 1 is cooled by means of cooling devices so that a strand shell 5 is formed. However, the core 6 of the metal strand 7 is still liquid. It only solidifies later. The cooling devices are not shown in FIG. 1. The partially solidified metal strand 7 (solidified strand shell 5, liquid core 6) is withdrawn from the continuous casting mold 1 by means of a withdrawal device 8.

The meniscus 9 of the liquid metal 3 in the continuous casting mold 1 should be kept as constant as possible. A withdrawal speed v, at which the partially solidified metal strand 7 is withdrawn from the continuous casting mold 1, is generally constant. Therefore—both in the prior art and in the various embodiments—the position of the closure device 4 is tracked in order to set the inflow of the liquid metal 3 in the continuous casting mold 1 in such a way that the meniscus 9 is kept as constant as possible.

An actual value hG of the meniscus 9 is acquired by means of a corresponding measuring device 10 (known per se). The actual value hG is fed to a control device 11 for the continuous casting machine. The control device 11 uses a control method, which will be explained in more detail below, to determine a target position p* to be adopted by the closure device 4. The closure device 4 is then controlled accordingly by the control device 11. Generally, the control device 11 issues a corresponding control signal to an adjusting device 12 for the closure device 4. The adjusting device 12 can, for example, be a hydraulic cylinder unit.

Generally, a corresponding measuring device 13 (known per se) determines an actual position p of the closure device 4 and feeds it to the control device 11. Therefore, there is usually closed loop control of the closure position. Alternatively, open loop control would also be possible.

The control device 11 is embodied in such a way that, in operation, it executes a control method according to various embodiments. Generally, the mode of operation of the control device 11 is determined by a computer program 14 with which the control device 11 is programmed. To this end, the computer program 14 is stored inside the control device 11 in a data medium 15, for example a flash EPROM. Obviously, it is stored in machine-readable form.

The computer program 14 can be fed to the control device 11 via a mobile data medium 16, for example a USB memory stick (shown) or an SD storage card (not shown). Obviously, the computer program 14 is also stored in machine-readable form on the mobile data medium 16. Alternatively, it is possible for the computer program 14 to be fed to the control device 11 via a computer network link or a programming unit.

The computer program 14 comprises a machine code 17 that can be executed directly by the control device 11. The execution of the machine code 17 by the control device 11 causes the control device 11 to control the meniscus 9 of the continuous casting mold 1 according to a control method according to various embodiments. This control method is explained in more detail in the following in conjunction with FIGS. 2 and 3.

Figure 2:
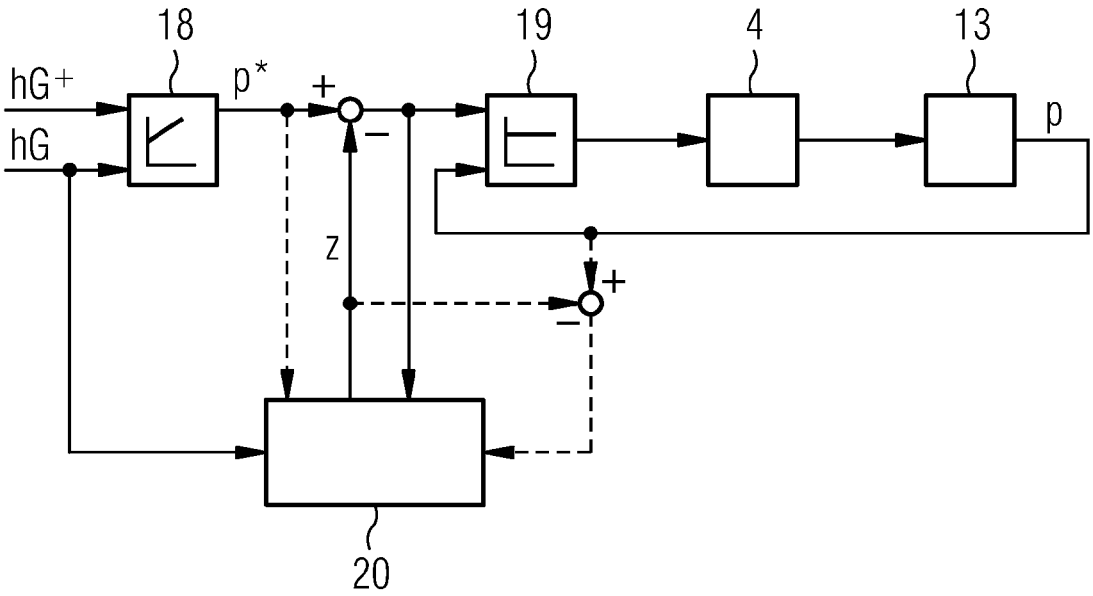
FIG. 2 a control engineering block diagram of a control arrangement

FIG. 2 shows a control arrangement implemented by the control device 11. The operation of the control arrangement in FIG. 2 enables a control method according to various embodiments for the meniscus 9 of the continuous casting mold 1.

According to FIG. 2, the control arrangement comprises a meniscus controller 18. The meniscus controller 18 determines the target position p* for the closure device 4 on the basis of a target value hG* for the meniscus 9 and the actual value hG for the meniscus 9 acquired by means of the measuring device 10 according to a controller characteristic. According to the depiction in FIG. 2, the controller characteristic of the meniscus controller 18 is proportional and integral. However, alternatively, other controller characteristics are possible, for example PID, PT1, PT2, etc.

The target position p* for the closure device 4 is fed to the closure device 4. However, prior to this, the target position p* is corrected by a disturbance variable compensation value z.

As already mentioned, the setting of the closure device 4 is controlled by closed loop control. In this case, which is depicted in FIG. 2, the corrected target position, that is the value $$p^*-z$$

is fed to a position controller 19, to which, in addition, the actual position p of the closure device 4 is also fed. The position controller 19 can, for example, be embodied as a P controller.

Due to the inflow of the liquid metal 3 set thereby, the actual position p of the closure device 4 acts on the meniscus 9 itself. The actual value hG of the meniscus 9 is acquired and, as already mentioned, fed to the meniscus controller 18.

The continuous casting mold 1 can be exposed to disturbance variables which influence the meniscus 9. A disturbance variable compensator 20 is provided to compensate the disturbance variables. The measured actual value hG of the meniscus 9 and a further variable are fed to the disturbance variable compensator 20.

According to FIG. 2, the target position p* of the closure device 4 corrected by the disturbance variable compensation value z is fed to the disturbance variable compensator 20 as a further variable. Alternatively, the uncorrected target position p* can be fed to the disturbance variable compensator 20. This alternative is indicated by a dashed line in FIG. 2. Its equivalence with the achieved object is immediately evident. This is because, according to FIG. 2, the disturbance variable compensation value z is determined by the disturbance variable compensator 20 on the basis of the values fed to it. The corrected target position, that is the value p*−z, can therefore also be determined without more ado within the disturbance variable compensator 20.

The determination of the disturbance variable compensation value z using (inter alia) the corrected or uncorrected target position p*−z or p* of the closure device 4 may be preferred for the purposes of the various embodiments. Alternatively, the actual position p or the actual position p−z of the closure device 4 corrected by the disturbance variable compensation value z can be fed to the disturbance variable compensator 20. These alternatives are also shown by dashed lines in FIG. 2.

The structure and mode of operation of the disturbance variable compensator 20 are explained in more detail in the following in conjunction with FIG. 3.

Figure 3:
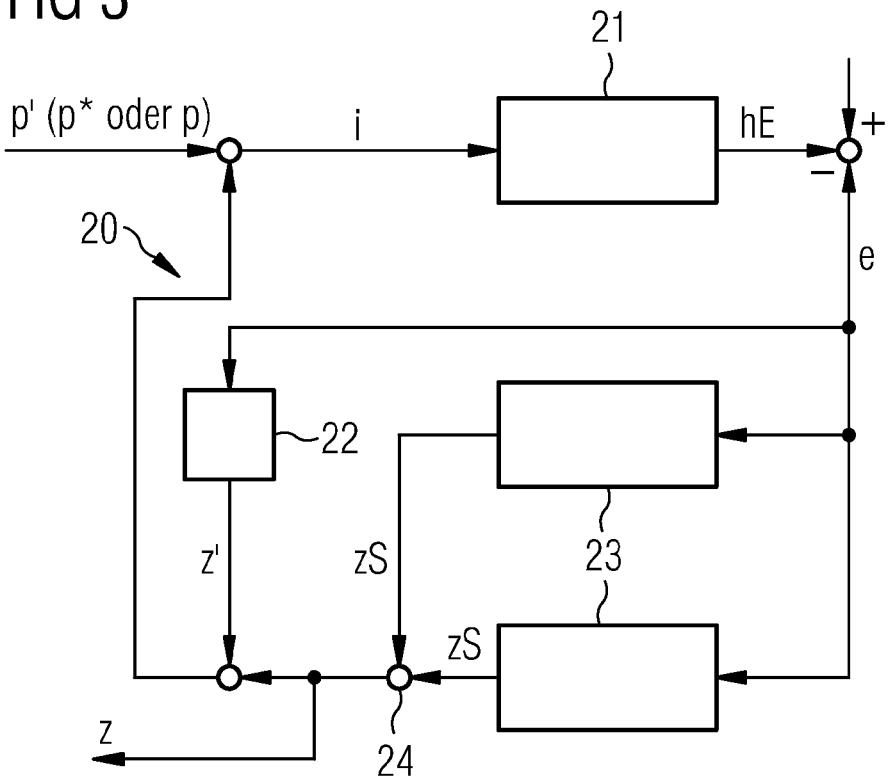
FIG. 3 a schematic diagram of the internal structure of a disturbance variable compensator FIG. 4 a possible embodiment of the disturbance variable compensator in FIG. 3

According to FIG. 3, the disturbance variable compensator 20 inter alia comprises a model 21 of the continuous casting mold 1. The disturbance variable compensator 20 uses the model 21 to determine an expected value hE for the meniscus 9. To this end a model input value i determined by the relationship $$I=p'+z'$$

is fed to the model 21. In the above relationship, p' is the uncorrected target position p* of the closure device 4, that is the output signal from the meniscus controller 18. If the actual position p of the closure device 4 were fed to the disturbance variable compensator 20 instead of the target position p*, in the above relationship, the value p would have to be used instead of the value p*·z' is a jump compensation value.

The jump compensation value z' is determined by the disturbance variable compensator 20 by means of a jump determiner 22, which is also a component of the disturbance variable compensator 20. According to FIG. 3, the jump compensation value z' is determined on the basis of the difference e between the actual value hG and the expected value hE of the meniscus 9, in the following statements in relation to FIG. 3, this is only referred to in short as the "difference e".

According to FIG. 3, the disturbance variable compensator 20 also comprises a number of oscillating compensators 23. The disturbance variable compensator 20 uses the oscillating compensators 23 to determine in each case a disturbance proportion zS each relative to a respective interference frequency fS, in the following called the interference frequency component zS. The determination is based on the difference e.

The minimum number of oscillating compensators 23 is one. In this case, only one single frequency disturbance proportion zS is compensated. Alternatively, the number of oscillating compensators 23 can be greater than one. In this case, the corresponding interference frequency component zS is determined for each oscillating compensator 23 each with its own interference frequency fS.

FIG. 3 shows two oscillating compensators 23 of this kind. However, embodiments with three, four, five, etc. oscillating compensators 23 are also conceivable.

The output signals zS from the oscillating compensators 23 are summated in a nodal point 24, the result of which corresponds to the disturbance variable compensation value z. In the case of only one single oscillation compensator 23, obviously no summation is necessary, since, in this case, the sum total is identical to the single summand.

Figure 4:
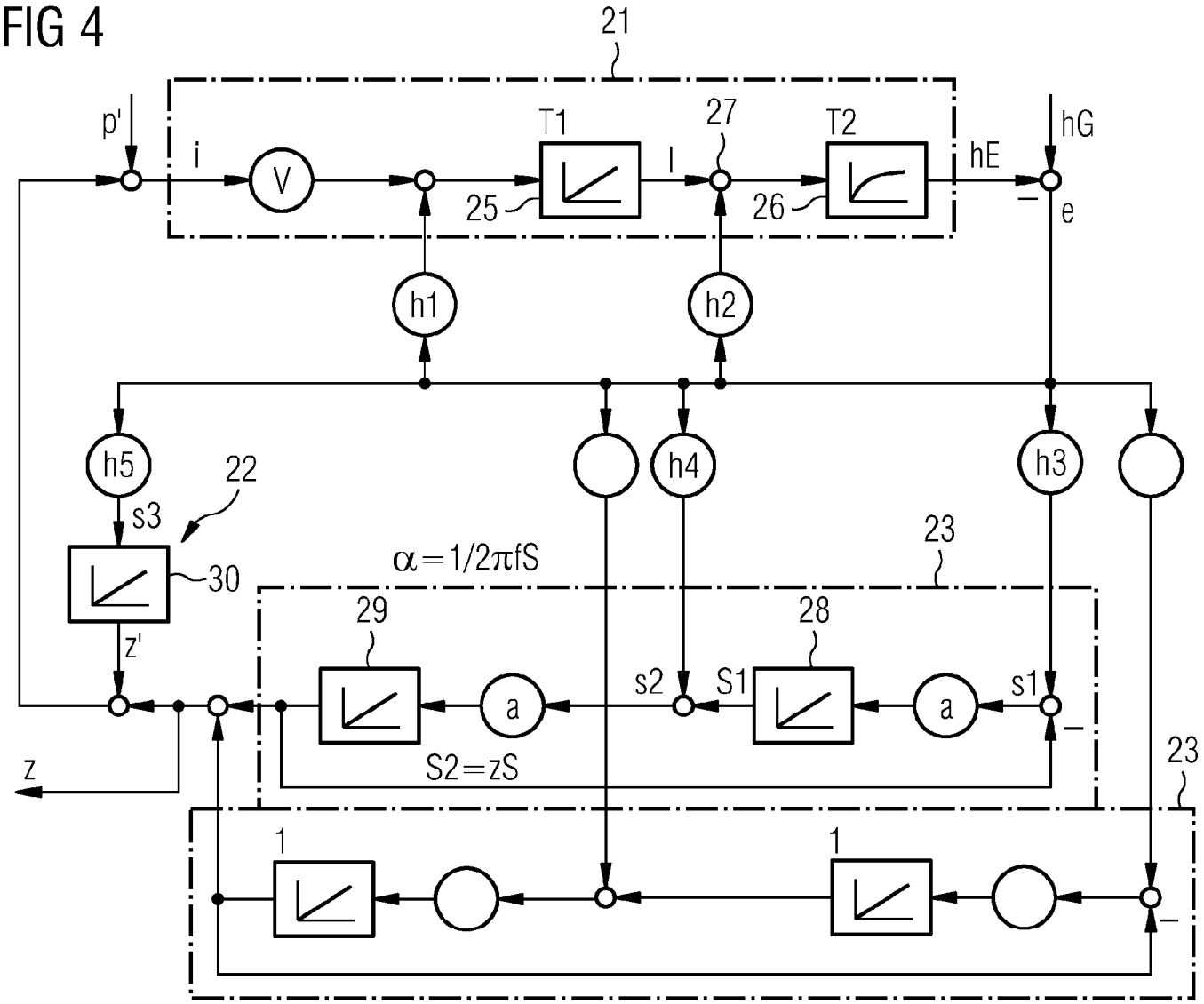

In an embodiment of the disturbance variable compensator 20—see FIG. 4—the model 21 of the continuous casting mold 1 consists of an integrator 25 and a time-delay element 26, which, according to the depiction in FIG. 4, are connected in series. Since the integrator 25 and the time-delay element 26 are components of the model 21 of the continuous casting mold 1, in the following they are supplemented by the term "model". Therefore, they are referred to as a model integrator 25 and a model delay element 26. However, the supplement "model" only serves to identify this association. No further significance is attached to the supplement "model".

The model integrator 25 comprises an integration time constant T1, the model delay element 26 a delay time constant T2. The time constants T1, T2 are determined in such a way that they describe the real continuous casting mold 1 as realistically as possible.

A value $$m=V\cdot i+h1\cdot e$$

is fed to the model integrator 25 as an input signal m. V is an amplification factor. i is the model input value already mentioned. e is the difference which has also already been mentioned. h1 is an adaptation factor.

The model integrator 25 supplies an output signal I. The output signal I is corrected in a nodal point 27 by a value $$h2\cdot e$$

and then fed to the model delay element 27 as its input signal. h2 is a further adaptation factor.

The variables I and h2·e fed to the nodal point 27 are summated in the nodal point. This results from the fact that the two input signals I, h2·e of the nodal point 27 are not provided with minus signs on the input side of the nodal point 27.

The adaptation factors h1 and h2 are related to the model 21 of the continuous casting mold 1. Therefore, in the following, they are referred to as model adaptation factors h1, h2.

The oscillating compensators 23 essentially have the same structure. Therefore, in the following only one of the oscillating compensators 23 will be described in detail, namely the upper oscillating compensator 23 shown in FIG. 4. However, the statements made are equally applicable to the other oscillating compensators 23.

According to FIG. 4, the upper oscillating compensator 23 in FIG. 4 comprises two integrators 28, 29 which are connected in series.

The two integrators 28, 29 are described in the following as oscillating integrators 28, 29 since they are components of the corresponding oscillation compensator 23. The supplement "oscillating" serves solely to indicate the association of these two integrators 28, 29 to the respective oscillating compensator 23. No further significance is attached to the supplement "oscillating".

The oscillating integrators 28, 29 have an integration time constant a. The integration time constant a amounts to $$a=\frac{1}{2\pi fS}$$

fS is the respective interference frequency to be compensated. The interference frequency fS must be known in advance.

According to FIG. 4, the value $$s1=h3\cdot e-S2$$

is fed to the front oscillation generator 28 as input value s1. The value $$s2=h4\cdot e+S1$$

is fed to the back oscillation generator 29 as input value s2. S1 and S2 are the output signals of the front and of the back oscillation generator 28, 29. h3 and h4 are adaptation factors. Due to their association with the respective oscillating compensator 23, they are referred to in the following as oscillation adaptation factors h3, h4.

The jump determiner 22 consists of a single integrator 30, which due to its association with jump determiner 22, is referred to in the following as a jump integrator 30. It is fed a value $$s3=h5\cdot e,$$

wherein h5 is an adaptation factor, in the following referred to as a jump adaptation factor.

As already mentioned, there can be a plurality of oscillating compensators 23. In this case, the oscillation adaptation factors h3, h4 of the individual oscillating compensators 23 are independent of each other. In addition, the integration time constants a of all the oscillating compensators 23 are different from one another.

To determine the adaptation factors h1 to h5, that is the model adaptation factors h1, h2, of the jump adaptation factor h5 and for each oscillating compensator 23 of the two respective oscillation adaptation factors h3, h4, preferably the transmission function of the system shown in FIG. 4 is determined first. The transmission function is a broken rational function of the Laplace operators, which means a function, which may be depicted as a quotient of a numerator and a denominator, wherein both the numerator and the denominator are polynomials of the Laplace operator. Both the numerator polynomial and the denominator polynomial contain the adaptation factors h1 to h5 in their coefficients.

Now, the desired zero settings are specified for the denominator polynomial, that is the desired poles of the transmission function. This produces an equation system, in which only the adaptation factors h1 to h5 are unknown. The equations of the equation system are independent of one another. Their number conforms to the number of adaptation factors h1 to h5. The equation system may, therefore, be used to determine the adaptation factors h1 to h5 unequivocally.

Preferably, the desired poles are specified as follows: for each interference frequency fS to be compensated, a pair of conjugate-complex poles is specified. The imaginary parts of the respective pole pair are equal to $+/-2\pi fS$. As already mentioned, fS is the interference frequency fS to be compensated. The imaginary parts are, therefore (in terms of value)

equal to the corresponding angular interference frequency ωS. The real parts of the respective pole pair are smaller than zero.

The three further poles are preferably all real and smaller than zero, that is negative.

If the model time constants T1, T2 model the real continuous casting mold 1 well, the real parts of the conjugate-complex poles and the real poles are variable within wide limits, without this impairing the quality of the control method. However, frequently, the correct model time constants T1, T2 can only be roughly estimated. Nevertheless, the control quality is good if the real parts of the conjugate-complex poles and the real poles fulfill specific criteria.

The stability of the control method can, for example, be increased if the real parts of the conjugate-complex poles lie between −0.1 times and −0.3 times the corresponding angular interference frequency ωS. In experiments, it has been found to be particularly advantageous for the real parts to be approximately equal to −0.2 times the corresponding angular interference frequency ωS.

It has also been found to be advantageous for the real poles all to be smaller than −2.0 or to differ from one another in pairs. It is even better for both criteria to be met. Particularly good results are achieved if one of the real poles lies at −3.0, one at −4.0 and one at −5.0 (in each case +/−0.5, preferably +/−0.2).

Figure 5:
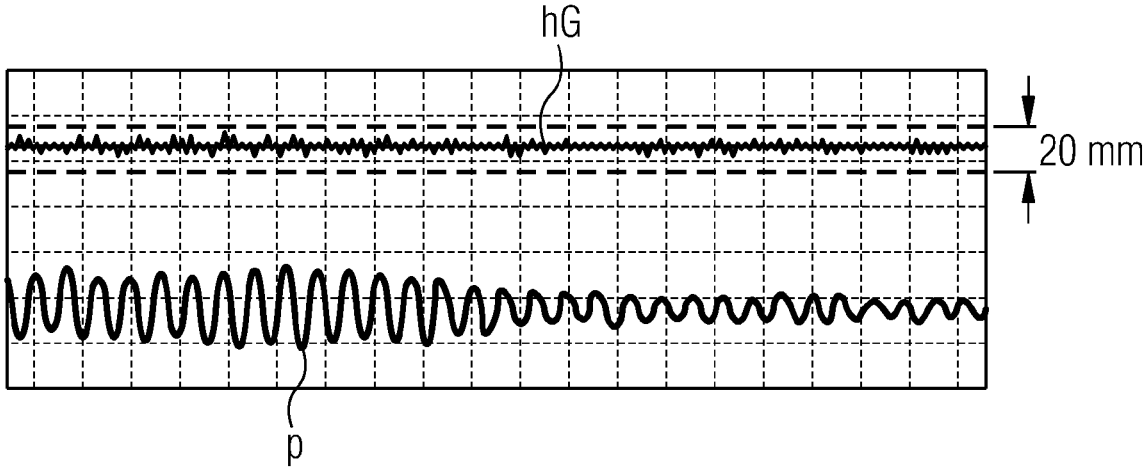
FIG. 5 temporal courses of an actual meniscus value and a closure position when using a control method according to various embodiments, and FIG. 6 the corresponding variables when using a control method from the prior art.

FIG. 5 shows a course of the measured actual value hG of the meniscus 9 and a corresponding course of the actual position p of the closure device 4 of a real continuous casting mold 1 as a function of time. In the case of the courses in FIG. 5, the meniscus 9 was controlled in a manner according to various embodiments, wherein two interference frequencies fS were compensated and the adaptation factors h1 to h5 were set to the above-explained optimum values. Although it is evident that considerable variations of the actual position p of the closure device 4 are necessary, the meniscus 9 remains very stable. The fluctuation is only about +/− three millimeters.

Figure 6:
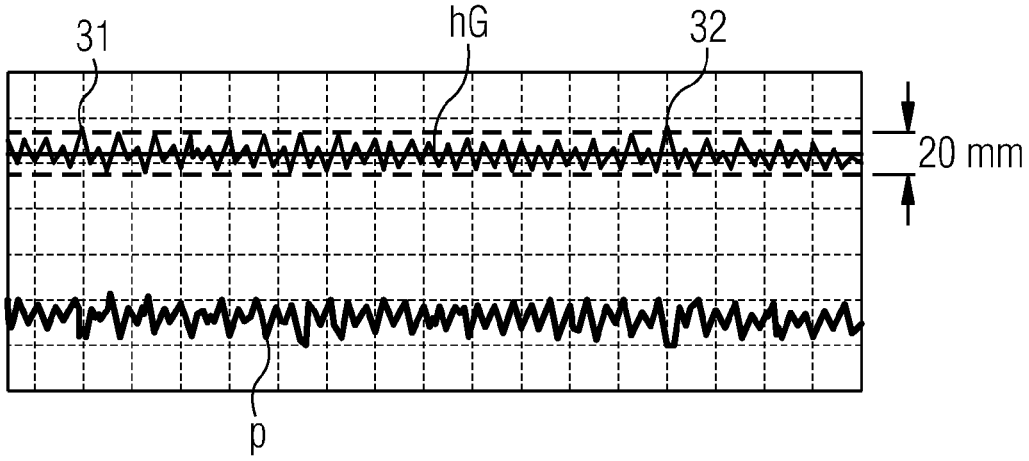

On the other hand, FIG. 6 shows the corresponding courses of a meniscus control from the prior art. It is evident that the meniscus 9 fluctuates significantly more strongly. For a short time, namely at points 31 and 32, it even leaves the specified tolerance band of +/− ten millimeters.

It was mentioned above that the interference frequencies fS to be compensated must be known in advance. The interference frequencies fS can, for example, be determined by evaluating the time characteristic of the actual value p of the meniscus 9 in FIG. 6. It is then possible to determine the corresponding interference frequencies fS and hence also the integration time constants a.

The above specification serves exclusively to explain the present invention. The scope of protection of the present invention should, however, be determined exclusively by the appended claims.

What is claimed is:

1. A control method for the meniscus of a continuous casting mold, comprising setting the inflow of liquid metal into the continuous casting mold by means of a closure device and withdrawing the partially solidified metal strand from the continuous casting mold by means of a withdrawal device, feeding a measured actual value of the meniscus to a meniscus controller, which determines a target position for the closure device on the basis of the actual value and a corresponding target value, feeding the measured actual value of the meniscus to a disturbance variable compensator, feeding the target position for the closure device, a target position for the closure device corrected by a disturbance variable compensation value, an actual position of the closure device or an actual position of the closure device corrected by the disturbance variable compensation value to the disturbance variable compensator, determining by the disturbance variable compensator the disturbance variable compensation value on the basis of values fed to it, feeding the target position corrected by the disturbance variable compensation value to the closure device, wherein the disturbance variable compensator comprises a model of the continuous casting mold, by means of which the disturbance variable compensator determines an expected value for the meniscus on the basis of a model input value, wherein the disturbance variable compensator comprises a number of oscillating compensators, by means of which the disturbance variable compensator determines an interference frequency component on the basis of a difference between the actual value and the expected value each relative to a related interference frequency, wherein the sum of the interference frequency components corresponds to the disturbance variable compensation value, wherein the model input value is determined by the relationship $$i = p' + z'$$

wherein p' is the uncorrected target or actual position of the closure device and z' is a jump compensation value, and wherein the disturbance variable compensator comprises a jump determiner, by means of which the disturbance variable compensator determines the jump compensation value by integrating the difference between actual value and expected value.

2. The control method according to claim 1, wherein the model of the continuous casting mold consists of a series connection of a model integrator with a model delay element, each oscillating compensator consists of a series connection of two oscillating integrators and the jump determiner consists of an individual jump integrator, as the respective input value a value m=Vi+h1e is fed to the model integrator, a value m'=I+h2e is fed to the model delay element, a value s1=h3e−S2 is fed to the front oscillation generator of a respective oscillation compensator, a value s2=h4e+S1 is fed to the back oscillation generator of a respective oscillation compensator and a value s3=h5e is fed to the jump integrator, wherein V is an amplification factor, i is the model input value, e is the difference between the actual value and the expected value, I is the output signal from the model integrator, S1 is the output signal from the respective front oscillation generator, S2 is the output signal from the respective back oscillation generator, h1 and h2 are model adaptation factors, h3 and h4 are specific oscillation adaptation factors for the respective oscillating compensator and h5 is a jump adaptation factor.

3. The control method according to claim 2, wherein the adaptation factors are determined in such a way that the poles of the transmission function determined by the model of the continuous casting mold fulfill the following conditions:

for each interference frequency, a pair of conjugate complex poles is formed, whose real parts are smaller than zero and whose imaginary parts are equal to an angular interference frequency defined by the respective interference frequency, three real poles are formed, which are all smaller than zero.

4. The control method according to claim 3, wherein the adaptation factors are determined in such a way that the real parts of the conjugate-complex poles, relative to the respective angular interference frequency, are between −0.3 and −0.1.

5. The control method according to claim 3, wherein the adaptation factors are determined in such a way that the real poles are all smaller than −2.0.

6. The control method according to claim 3, wherein the adaptation factors are determined in such a way that the real poles differ from one another in pairs.

7. The control method according to claim 3, wherein the adaptation factors are determined in such a way that one of the real poles is between −2.5 and −3.5, one is between −3.5 and −4.5 and one is between −4.5 and −5.5.

8. The control method according to claim 1, wherein the number of oscillating compensators is greater than one.

9. The control method according to claim 1, wherein the target position for the closure device or the target position for the closure device corrected by the disturbance variable compensation value is fed to the disturbance variable compensator, but not the actual position of the closure device or the actual position of the closure device corrected by the disturbance variable compensation value.

10. A computer program product comprising a non-transitory computer readable storage medium comprising machine code which when executed directly by a control device for a continuous casting machine causes the control device to control the meniscus of a continuous casting mold of the continuous casting machine according to a control method according to claim 1.

11. The computer program product according to claim 10, wherein the data medium is a component of the control device.

12. A control device for a continuous casting machine, wherein the control device is embodied in such a way that, in operation, to set the inflow of liquid metal into the continuous casting mold by means of a closure device and to withdraw the partially solidified metal strand from the continuous casting mold by means of a withdrawal device, to feed a measured actual value of the meniscus to a meniscus controller, which determines a target position for the closure device on the basis of the actual value and a corresponding target value, to feed the measured actual value of the meniscus to a disturbance variable compensator, to feed the target position for the closure device, a target position for the closure device corrected by a disturbance variable compensation value, an actual position of the closure device or an actual position of the closure device corrected by the disturbance variable compensation value to the disturbance variable compensator, to determine by the disturbance variable compensator the disturbance variable compensation value on the basis of values fed to it, to feed the target position corrected by the disturbance variable compensation value to the closure device, wherein the disturbance variable compensator comprises a model of the continuous casting mold, by means of which the disturbance variable compensator determines an expected value for the meniscus on the basis of a model input value, wherein the disturbance variable compensator comprises a number of oscillating compensators, by means of which the disturbance variable compensator determines an interference frequency component on the basis of a difference between the actual value and the expected value each relative to a related interference frequency, wherein the sum of the interference frequency components corresponds to the disturbance variable compensation value, wherein the model input value is determined by the relationship $$i=p'+z'$$

wherein p' is the uncorrected target or actual position of the closure device and z' is a jump compensation value, and wherein the disturbance variable compensator comprises a jump determiner, by means of which the disturbance variable compensator determines the jump compensation value by integrating the difference between actual value and expected value.

13. A continuous casting machine, wherein it is controlled by a control device according to claim 12.

14. The control device according to claim 12, wherein the model of the continuous casting mold consists of a series connection of a model integrator with a model delay element, each oscillating compensator consists of a series connection of two oscillating integrators and the jump determiner consists of an individual jump integrator, as the respective input value a value m=Vi+h1e is fed to the model integrator, a value m'=I+h2e is fed to the model delay element, a value s1=h3e−S2 is fed to the front oscillation generator of a respective oscillation compensator, a value s2=h4e+S1 is fed to the back oscillation generator of a respective oscillation compensator and a value s3=h5e is fed to the jump integrator, wherein V is an amplification factor, i is the model input value, e is the difference between the actual value and the expected value, I is the output signal from the model integrator, S1 is the output signal from the respective front oscillation generator, S2 is the output signal from the respective back oscillation generator, h1 and h2 are model adaptation factors, h3 and h4 are specific oscillation adaptation factors for the respective oscillating compensator and h5 is a jump adaptation factor.

15. The control device according to claim 14, wherein the adaptation factors are determined in such a way that the poles of the transmission function determined by the model of the continuous casting mold fulfill the following conditions:

for each interference frequency, a pair of conjugate complex poles is formed, whose real parts are smaller than zero and whose imaginary parts are equal to an angular interference frequency defined by the respective interference frequency, three real poles are formed, which are all smaller than zero.

16. The control device according to claim 15, wherein the adaptation factors are determined in such a way that the real parts of the conjugate-complex poles, relative to the respective angular interference frequency, are between −0.3 and −0.1.

17. The control device according to claim 15, wherein the adaptation factors are determined in such a way that the real poles are all smaller than −2.0.

18. The control device according to claim 15, wherein the adaptation factors are determined in such a way that the real poles differ from one another in pairs.

19. The control device according to claim 15, wherein the adaptation factors are determined in such a way that one of the real poles is between −2.5 and −3.5, one is between −3.5 and −4.5 and one is between −4.5 and −5.5.

20. The control device according to claim 12, wherein the number of oscillating compensators is greater than one.

21. The control device according to claim 12, wherein the target position for the closure device or the target position for the closure device corrected by the disturbance variable compensation value is fed to the disturbance variable compensator, but not the actual position of the closure device or the actual position of the closure device corrected by the disturbance variable compensation value.

* * * * *